US009047877B2

(12) United States Patent
Dai et al.

(10) Patent No.: US 9,047,877 B2
(45) Date of Patent: Jun. 2, 2015

(54) METHOD AND DEVICE FOR AN SILENCE INSERTION DESCRIPTOR FRAME DECISION BASED UPON VARIATIONS IN SUB-BAND CHARACTERISTIC INFORMATION

(75) Inventors: Jinliang Dai, Shenzhen (CN); Eyal Shlomot, Shenzhen (CN); Deming Zhang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 233 days.

(21) Appl. No.: 12/763,573

(22) Filed: Apr. 20, 2010

(65) Prior Publication Data

US 2010/0268531 A1 Oct. 21, 2010

Related U.S. Application Data

(63) Continuation of application No. PCT/CN2008/072774, filed on Oct. 21, 2008.

(30) Foreign Application Priority Data

Nov. 2, 2007 (CN) ..... 2007 1 0166748
Mar. 18, 2008 (CN) ..... 2008 1 0084319

(51) Int. Cl.
*G10L 19/012* (2013.01)
*G10L 19/24* (2013.01)
*G10L 25/78* (2013.01)

(52) U.S. Cl.
CPC ..... *G10L 25/78* (2013.01); *G10L 19/24* (2013.01); *G10L 19/012* (2013.01)

(58) Field of Classification Search
CPC ... G10L 19/012; G10L 21/0208; G10L 15/22; G10L 15/20; G10L 19/028; G10L 2021/02087; G10L 25/78; G10L 19/0204; G10L 19/24; G10L 9/02; H04B 1/665; G06F 17/2735; G11C 2207/16
USPC ..... 704/201, 210, 215, E19.006, 229, 10, 704/226, 227, 231, 233, 13, E21.006, 704/E19.044
See application file for complete search history.

(56) References Cited

U.S. PATENT DOCUMENTS 5,694,429 A * 12/1997 Sekine et al. ..... 375/262
5,960,389 A 9/1999 Jarvinen et al.

(Continued)

FOREIGN PATENT DOCUMENTS

CN 1440602 A 9/2003
JP 10-190498 A 7/1998

(Continued)

OTHER PUBLICATIONS

Jelinek et al. "Wideband Speech Coding Advances in VMR-WB Standard" May 2007.*

(Continued)

*Primary Examiner* — James Wozniak
(74) *Attorney, Agent, or Firm* — Huawei Technologies Co., Ltd.

(57) ABSTRACT

A DTX decision method includes: obtaining sub-band signal(s) according to an input signal; obtaining a variation of characteristic information of each of the sub-band signals; and performing DTX decision according to the variation of the characteristic information of each of the sub-band signals. With the invention, a complete and appreciate DTX decision result is obtained by making full use of the noise characteristic in the speech encoding/decoding bandwidth and using band-splitting and layered processing. As a result, the SID encoding/CNG decoding may closely follow the characteristic variation of the actual noise.

8 Claims, 3 Drawing Sheets

(56) References Cited

U.S. PATENT DOCUMENTS

| | | | | |
|---|---|---|---|---|
| 5,963,901 | A * | 10/1999 | Vahatalo et al. | 704/233 |
| 5,978,761 | A * | 11/1999 | Johansson | 704/226 |
| 6,606,593 | B1 * | 8/2003 | Jarvinen et al. | 704/223 |
| 6,691,085 | B1 * | 2/2004 | Rotola-Pukkila et al. | 704/228 |
| 6,721,712 | B1 * | 4/2004 | Benyassine et al. | 704/503 |
| 6,810,273 | B1 | 10/2004 | Mattila et al. | |
| 7,039,181 | B2 * | 5/2006 | Marchok et al. | 379/406.03 |
| 7,610,197 | B2 * | 10/2009 | Cruz-Zeno et al. | 704/226 |
| 7,693,708 | B2 * | 4/2010 | Gournay et al. | 704/201 |
| 2002/0012330 | A1 | 1/2002 | Glazko et al. | |
| 2002/0101844 | A1 | 8/2002 | El-Maleh et al. | |
| 2002/0161573 | A1 | 10/2002 | Yoshida | |
| 2005/0004793 | A1 * | 1/2005 | Ojala et al. | 704/219 |
| 2005/0027520 | A1 * | 2/2005 | Mattila et al. | 704/228 |
| 2005/0075873 | A1 * | 4/2005 | Makinen | 704/230 |
| 2006/0149536 | A1 * | 7/2006 | Li | 704/215 |
| 2006/0217973 | A1 * | 9/2006 | Gao et al. | 704/221 |
| 2006/0217976 | A1 * | 9/2006 | Gao et al. | 704/233 |
| 2007/0147327 | A1 * | 6/2007 | Jin et al. | 370/342 |
| 2007/0265842 | A1 * | 11/2007 | Jarvinen et al. | 704/214 |
| 2008/0010064 | A1 * | 1/2008 | Takeuchi et al. | 704/229 |
| 2008/0027716 | A1 * | 1/2008 | Rajendran et al. | 704/210 |
| 2008/0027717 | A1 * | 1/2008 | Rajendran et al. | 704/210 |
| 2008/0037618 | A1 * | 2/2008 | LeBlanc et al. | 375/222 |
| 2008/0195383 | A1 * | 8/2008 | Shlomot et al. | 704/205 |
| 2008/0306736 | A1 * | 12/2008 | Sanyal et al. | 704/233 |
| 2009/0055173 | A1 * | 2/2009 | Sehlstedt | 704/233 |

FOREIGN PATENT DOCUMENTS

| | | | |
|---|---|---|---|
| WO | WO 2006/084003 | A2 | 8/2006 |
| WO | WO 2007/091956 | A2 | 8/2007 |

OTHER PUBLICATIONS

Valin et a. "Speex: A Free Codec for Free Speech" 2006.*

ETSI EN 301 707 V7.4.1 (Nov. 2000).*

Ragot et al. "ITU-T G.729.1: AN 8-32 KBIT/S Scalable Coder Interoperable With G.729 for Wideband Telephony and Voice Over IP" Apr. 2007.*

Benyassine et al. "ITU-T Recommendation G.729 AnneB: A Silence Compression Scheme for Use with G.729 Optimized for V. 70 Digital Simultaneous Voice and Data Applications" 1997.*

Benyassine, Adil, et al. "ITU-T Recommendation G. 729 Annex B: a silence compression scheme for use with G. 729 optimized for V. 70 digital simultaneous voice and data applications." Communications Magazine, IEEE35.9, Sep. 1997, pp. 64-73.*

Examiner's Report in corresponding Australian Application No. 2008318143 (Apr. 11, 2011).

Vähätalo et al., "Voice Activity Detection for GSM Adaptive Multi-Rate Codec," 1999, Institute of Electronic and Electrical Engineers, Tampere, Finland.

Cheng et al., "The influence of low bit rate speech coders on speech recognition system," Application Research of Computers, 9: 22-25, 28 (Sep. 2003).

International Telecommunications Union, "Coding of speech at 8 kbit/s using conjugate-structure algebraic-code-excited linear prediction (CS-ACELP)," Series G: Transmission systems and media, digital systems and networks, ITU-T Recommendation G.729 (Jan. 2007).

International Telecommunications Union, "G.729-based embedded variable bit-rate coder: An 8-32 kbit/s scalable wideband code bitstream interoperable with G.729" Series G: Transmission systems and media, digital systems and networks, ITU-T Recommendation G.729.1 (May 2006).

State Intellectual Property Office of the People's Republic of China, International Search Report in International Patent Application No. PCT/CN2008/072774 (Jan. 15, 2009).

Zhou et al., "Discontinuous transmission in speech communication," Communication Technology, 9: 46-48 (Sep. 2001).

"TS 26.092—3rd Generation Partnership Project; Technical Specification Group Services and System Aspects; Mandatory speech codec speech processing functions; Adaptive Multi-Rate (AMR) speech codec; Comfort noise aspects, (Release 6)," Dec. 2004, V6.0.0, 3GPP, Valbonne, France.

"TS 26.192—3rd Generation Partnership Project; Technical Specification Group Services and System Aspects; Speech codec speech processing functions; Adaptive Multi-Rate—Wideband (AMR-WB) speech codec; Comfort noise aspects (Release 6)," Dec. 2004, V6.0.0, 3GPP, Valbonne, France.

1st Office Action in corresponding Chinese Patent Application No. 200810084319.1 (May 8, 2009).

Extended European Search Report in corresponding European Patent Application No. 08844412.0 (Jan. 4, 2013).

"G.729.1—Series G: Transmission Systems and Media, Digital Systems and Networks; Digital terminal equipments—Coding of analogue signals by methods other than PCM; G.729-based embedded variable bit-rate coder: An 8-32 kbit/s scalable wideband coder bitstream interoperable with G.729; Amendment 4: New Annex C (DTX/CNG scheme) plus corrections to main body and Annex B," Jun. 2008, ITU-T, Geneva, Switzerland.

Written Opinion of the International Searching Authority in corresponding International Patent Application No. PCT/CN2008/072774 (Jan. 15, 2009).

* cited by examiner

FIG. 1
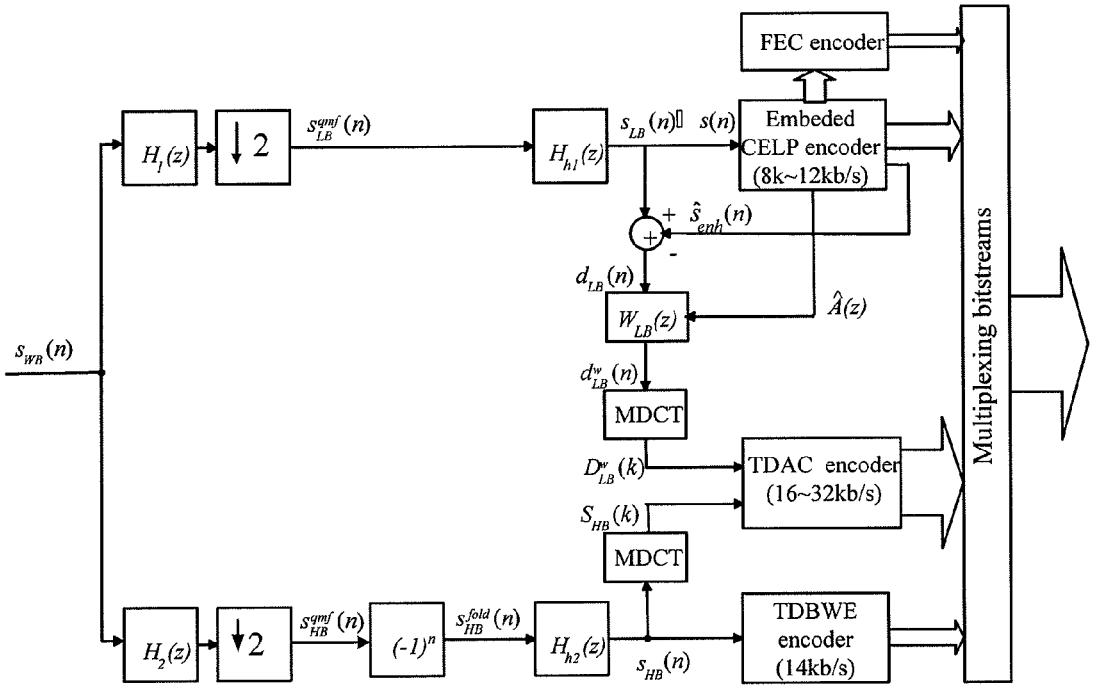
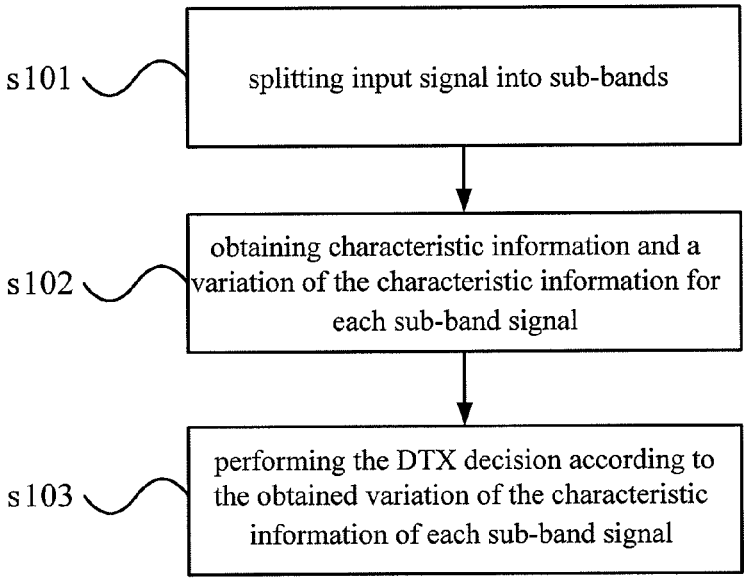
FIG. 2

METHOD AND DEVICE FOR AN SILENCE INSERTION DESCRIPTOR FRAME DECISION BASED UPON VARIATIONS IN SUB-BAND CHARACTERISTIC INFORMATION

CROSS-REFERENCE TO RELATED APPLICATIONS

This application is a continuation of copending International Patent Application No. PCT/CN2008/072774, filed on Oct. 21, 2008, entitled "Method and Device for DTX Decision," claiming the priority of Chinese Patent Application No. 200710166748.9, filed on Nov. 2, 2007, entitled "Method and Device for DTX Decision," and Chinese Patent Application No. 200810084319.1, entitled "Method and Device for DTX Decision," filed on Mar. 3, 2008, the contents of which are hereby incorporated by reference in their entireties for all purposes.

FIELD OF THE INVENTION

The present disclosure relates to the field of signal processing, and more particularly to a method and device for Discontinuous Transmission (DTX) decision.

BACKGROUND

Speech coding technique may be utilized to compress the transmission bandwidth of speech signals and increase the capacity of a communication system. During voice communication, only 40% of the time involves speech and the remaining part is relevant to silence or background noise. Therefore, for the purpose of further saving of the transmission bandwidth, DTX/CNG (Comfortable Noise Generation) technique is developed. With the DTX/CNG technique, a coder is allowed to apply an encoding/decoding algorithm different from that for the speech signal to the background noise signal, which results in reduction of the average bit rate. In short, by using DTX/CNG technique, when the background noise signal is encoded at the encoding end, it is not required to perform full-rate coding as those done for speech frames, nor is it required to encode each frame of the background noise. instead, encoded parameters (SID frame) having less amount of data than the speech frames are transmitted every several frames. At the decoding end, a continuous background noise is recovered according to the parameters in the received discontinuous frames of the background noise, which will not noticeably influence the subjective quality in acoustical The discontinuous coded frames of the background noise are generally referred to as Silence Insertion Descriptor (SID) frames. A SID frame generally includes only spectrum parameters and signal energy parameters. In contrast to a coded speech frames the SID frame does not include fixed-codebook, adaptive codebook and other relevant parameters. Moreover, the SID frame is not continuously transmitted, and thus the average bit rate is reduced. At the stage of background noise encoding, the noise parameters are extracted and detected, in order to determine whether a SID frame should be transmitted. Such a procedure is referred to as DTX decision. An output of the DTX decision is a "1" or "0," which indicates whether the SID frame shall be transmitted. The result of the DTX decision also shows whether there is a significant change in the nature of the current noise.

G.729.1 is a new-generation speech encoding/decoding standard that is recently issued by ITU. The most prominent feature of such an embedded speech encoding/decoding standard is layered coding. This feature may provide narrowband-wideband audio quality with the bit rate of 8 kb/s~32 kb/s, and the outer bit-stream is allowed to be discarded based on channel conditions during transmission so that it is of good channel adaptability.

In G.729.1 standard, hierarchy is realized by constructing a bitstream to be of an embedded and layered structure. The core layer is coded using the G.729 standard, which is a new embedded and layered multiple bit rate speech encoder A block diagram of a system including each layer of G.729.1 encoders is shown in FIG. 1. The input is a 20 ms superframe, which is 320 samples long when the sample rate is 16000 Hz. The input signal $S_{WB}(n)$ is first split into two sub-bands through QMF filtering ($H_1(z)$, $H_2(z)$). The lower-band signal $S_{LB}^{qmf}(n)$ is pre-processed by a high-pass filter with 50 Hz cut-off frequency. The resulting signal $s_{LB}(n)$ is coded by an 8-12 kb/s narrowband embedded CELP encoder. The difference signal $d_{LB}(n)$ between $s_{LB}(n)$ and the local synthesis signal $\hat{s}_{enh}(n)$ of the CELP encoder at 12 kb/s is processed by the perceptual weighting filter ($W_{LB}(z)$) to obtain the signal $d_{LB}^{w}(n)$, which is then transformed into frequency domain by MDCT. The weighting filter $W_{LB}(z)$ includes a gain compensation which guarantees the spectral continuity between the output $d_{LB}^{w}(n)$ of the filter and the higher-band input signal $s_{HB}(n)$. The weighted difference signal also needs to be transformed to the frequency domain.

The signal $s_{HB}^{fold}(n)$ obtained by spectral folding, i.e. by multiplying the higher-band component with $(-1)^n$, is pre-processed by a low-pass filter with a cut-off frequency of 3000 Hz. The filtered signal $s_{HB}(n)$ is coded by a TDBWE encoder. The signal $s_{HB}(n)$ that is input into the TDAC encoding module is also transformed into the frequency domain by MDCT.

The two sets of MDCT coefficients, $D_{LB}^{w}(k)$ and $S_{HB}(k)$, are finally coded by using the TDAC. In addition, some parameters are transmitted by the frame erasure concealment (FEC) encoder in order to improve quality when error occurs due to the presence of erased superframes during the transmission.

The full-rate bitstream coded by the G.729.1 encoder consists of 12 layers. The core layer has a bit rate of 8 kb/s, which is a G.729 bitstream. The lower-band enhancement layer has a bit rate of 12 kb/s, which is an enhancement of fixed codebook code of the core layer. Both the 8 kb/s and 12 kb/s layers correspond to the narrowband signal component. A layer having a bit rate of 14 kb/s, where a TDBWE encoder is utilized, corresponds to the wideband signal component. All the 16 kb/s to 32 kb/s layers are the enhancement coding of the full band signal.

The Adaptive Multi-Rate (AMR), which is adopted as the speech encoding/decoding standard by the 3rd Generation Partner Project (3GPP), has the following DTX strategy: when the speech segment ends, a SID_FIRST frame having only 1 bit of valid data is used to indicate the start of the noise segment. In the third frame after the SID_FIRST frame, a first SID_UPDATE frame including detailed noise information is transmitted. After that, a SID_UPDATE frame is transmitted under a fixed interval, e.g. every 8 frames. Only the SID_UPDATE frames include coded data of the comfortable noise parameters.

According to AMR, SID frames are transmitted under a fixed interval, which makes it impossible to adaptively transmit the SID frame based on the actual characteristic of the noise, that is, it can not ensure the transmission of SID frame when necessary. The method has some drawbacks when employed in a real communication system. On one hand, when the characteristic of the noise has changed, the SID frame cannot be transmitted in time and thus the decoding end cannot timely derive the changed noise information. On the other hand, when it is time to transmit the SID frame, the characteristic of the noise might keep stable for a rather long time (longer than 8 frames) and thus the transmission is not really necessary, which results in waste of bandwidth.

According to the silence compression scheme defined by the speech encoding standard 'Conjugate-structure algebraic-code-excited linear prediction (CS-ACELP)' (G.729) proposed by the International Telecom Union (ITU), the DTX strategy used at the encoding end involves adaptively determining whether to transmit the SID frame according to the variation of the narrowband noise parameters, where the minimum interval between two consecutive SID frames is 20 ms, and the maximum interval is not defined. The drawback of this scheme lies in that only the energy and spectrum parameters extracted from the narrowband signal is used to facilitate the DTX decision while the information of the wideband components is not used. As a result, it might be impossible to get a complete and appropriate DTX decision result for the wideband speech application scenarios.

Furthermore, with the wide application of the wideband speech encoder and the development of ultra-wideband technology, standards for wideband speech encoder with embedded and layered structure such as the G729.1 has been published and gradually employed. In the wideband speech encoder with layered structure, information of the narrowband and wideband noise components cannot be fully used by the DTX scheme according to AMR or G.729 by ITU, thus a DTX decision result fully reflecting the characteristic of the actual noise cannot be obtained, which makes it impossible to achieve the advantages of layered coding.

SUMMARY

Various embodiments of the present disclosure provide a method and device for DTX decision, in order to implement band-splitting and layered processing on the noise signal and obtain a complete and appreciate DTX decision result.

One embodiment of the present disclosure provides a method for DTX decision. The method includes: obtaining sub-band signal(s) by splitting input signal; obtaining a variation of characteristic information of each of the sub-band signal(s); and performing DTX decision according to the variation of the characteristic information of each of the sub-band signal(s).

One embodiment of the present disclosure provides a device for DTX decision. The device includes: a band-splitting module, configured to obtain sub-band signal(s) by splitting input signals; a characteristic information variation obtaining module, configured to obtain a variation of characteristic information of each of the sub-band signals split by the band-splitting module; and a decision module, configured to perform DTX decision according to the variation of the characteristic information of each of the sub-band signals obtained by the characteristic information variation obtaining module.

A complete and appreciate DTX decision result may be obtained by making full use of the noise characteristic in the bandwidth for speech encoding/decoding and using band-splitting and layered processing during noise coding segment. As a result, the SID encoding/CNG decoding may closely follow the variation in the characteristics of the actual noise.

BRIEF DESCRIPTION OF THE DRAWING(S)

FIG. 1 is a block diagram of a conventional system including each layer of G.729.1 encoders;

FIG. 2 is a flow chart of a DTX decision method according to Embodiment One of the present disclosure;

DETAILED DESCRIPTION

Figure 3:
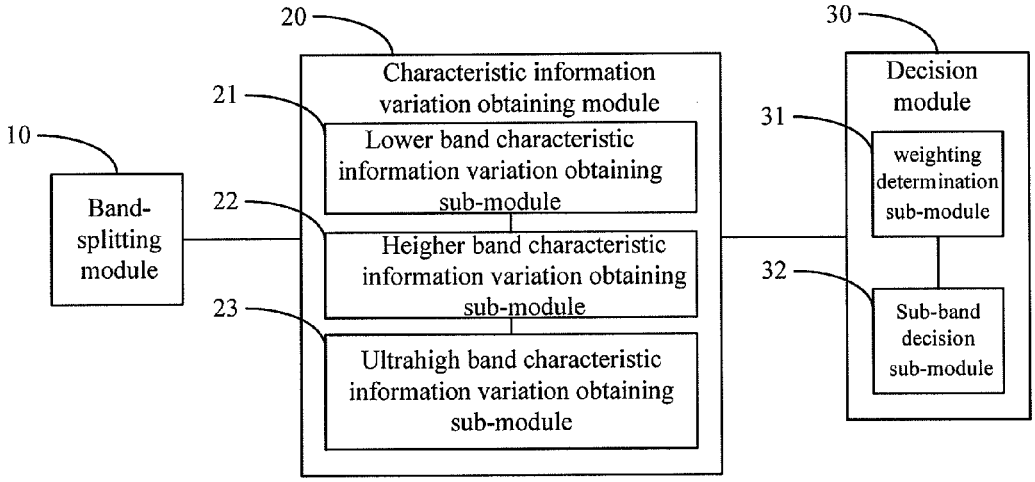
FIG. 3 is a block diagram of a DTX decision device according to Embodiment Five of the present disclosure.

A DTX decision method according to Embodiment One of the present disclosure is shown in FIG. 2. The method includes the following steps.

At block s101, an input signal is band-split.

At this step, when the input signal is a wideband signal, the wideband signal may be split into two subbands, i.e. a lower-band and a higher-band. When the input signal is an ultra-wideband signal, the ultra-wideband signal may be split into a lower-band, a higher-band and an ultrahigh-band signal in one go, or it may be first split into an ultrahigh-band signal and a wideband signal which is then split into a higher-band signal and a lower-band signal. For a lower-band signal, it may be further split into a lower-band core layer signal and a lower-band enhancement layer signal. For a higher-band signal, it may be further split into a higher-band core layer signal and a higher-band enhancement layer signal. The band-splitting may be realized by using Quadrature Mirror Filter (QMF) banks. A specific splitting standard may be as follows: a narrowband signal is a signal having a frequency range of 0~4000 Hz, a wideband signal is a signal having a frequency range of 0~8000 Hz, and an ultra-wideband signal is a signal having a frequency range of 0~16000 Hz. Both the narrowband and lower-band (a wideband component) signals refer to 0~4000 Hz signal, the higher-band (a wideband component) signal refers to 4000~8000 Hz signal, and the ultrahigh-band (an ultra-wideband component) signal refers to 8000~16000 Hz signal.

The following step is also included conventional to s101: when a Voice Activity Detector (VAD) function detects that the signal changes from speech to noise, the encoding algorithm enters a hangover stage. At the hangover stage, the encoder still encodes the input signal according to the encoding algorithm for speech frames, which is mainly to estimate the characteristic of the noise and initialize the subsequent encoding algorithm for noise. The noise encoding starts after the trailing stage ends and the input signal is split.

At block s102, characteristic information of each sub-band signal and a variation of the characteristic information are obtained.

Specifically, for the lower-band signal, the characteristic information includes the energy and spectrum information of the lower-band signal, which may be obtained by using a linear prediction analysis model.

For the higher-band and ultrahigh-band signal, the characteristic information includes time envelope information and frequency envelope information, which may be obtained by using Time Domain Band Width Extension (TDBWE) encoding algorithm.

A variation metric of a signal within a sub-band may be found by comparing the obtained characteristic information of the signal within the sub-band and the characteristic information of the signal within the sub-band obtained at a past time.

At block s103, the DTX decision is performed according to the obtained variation of the characteristic information of the sub-band signal.

For the wideband signal, the variation metrics of the characteristic of the lower-band noise and that of the higher-band noise are synthesized as the wideband DTX decision result. For the ultra-wideband signal, the variation metrics of the characteristic of the wideband signal and that of the ultrahigh-band signal are synthesized as the DTX decision result for the whole ultra-wideband.

If full-rate coding information of the input noise signal is split into the lower-band core layer, lower-band enhancement layer, higher-band core layer, higher-band enhancement layer and ultrahigh-band layer, where their bit rates increase in turn, then the layer structure of the encoded noise may be mapped to the actual bit rate.

If the actual coding only involves the lower-band core layer, then in the DTX decision, it is only computed the variation of the characteristic information corresponding to the lower-band core layer. If the decision function has a value larger than a threshold, then the SID frame is transmitted; otherwise the SID frame is not transmitted.

If the actual coding is up to the lower-band enhancement layer, then the DTX decision may be done by combining the variations of the characteristic information of both the lower-band core layer and the lower-band enhancement layer together. If the decision function has a value larger than a threshold, then the SID frame is transmitted; otherwise the SID frame is not transmitted.

If the actual coding is up to the higher-band core layer, then the combined variation of the characteristic information of the lower-band component and the variation of the characteristic information for the higher-band core layer are used to perform a combined DTX decision. If the decision function has a value larger than a threshold, then the SID frame is transmitted; otherwise the SID frame is not transmitted.

If the actual coding is up to the higher-band enhancement layer, then the combined variation of the characteristic information of the lower-band component and the combined variation of the characteristic information of the wideband component are used to perform the combined DTX decision. If the decision function has a value larger than a threshold, then the SID frame is transmitted; otherwise the SID frame is not transmitted.

If the actual coding is up to the ultrahigh-band, then the combined variation of the characteristic information of the full-band signal is used to perform the DTX decision. If the decision function has a value larger than a threshold, then the SID frame is transmitted; otherwise the SID frame is not transmitted.

Base on the above description, the variation of the characteristic information of the full-band signal may be expressed as equation (1):

$$J=\alpha J_1+\beta J_2+\gamma J_3 \tag{1}$$

According to this equation, a first method for DTX decision may be derived as follows.

Herein, $\alpha+\beta+\gamma=1$, and $J_1$, $J_2$, $J_3$ represent the variations of the characteristic information for the lower-band, higher-band and ultrahigh-band respectively. Thus, the DTX decision rule may be shown as equation (2). If J>1, the output dtx_flag of the DTX decision is 1, which shows that it is necessary to transmit the coded information of the noise frame; otherwise if dtx_flag is 0, it indicates that it is not necessary to transmit the coded information of the noise frame:

$$\begin{cases} \text{dtx_flag}=1 & J>1 \\ \text{dtx_flag}=0 & J\le 1 \end{cases} \tag{2}$$

When the coding is only up to the lower-band core layer or lower-band enhancement layer, equation (1) is reduced to:

$$J=J_1 \tag{3}$$

When the coding is up to the higher-band core layer or higher-band enhancement layer, equation (1) is reduced to:

$$J=\alpha J_1+\beta J_2 \tag{4}$$

where, $\alpha+\beta=1$.

Other DTX decision methods, such as a second DTX decision method described in the following may be used as well.

The computed variation of the characteristic information for the lower-band, higher-band and ultrahigh-band are respectively represented by $J_1$, $J_2$, $J_3$.

When the coding is up to the lower-band core layer or lower band enhancement layer, as shown in equation (3), $J_1$ is used as the DTX decision criterion.

When the coding is up to the higher-band core layer or higher-band enhancement layer, $J_1$ and $J_2$ are used as the DTX decision criteria. When both $J_1$ and $J_2$ are smaller than 1, the output dtx_flag of the DTX decision is 0, which indicates that it is not necessary to transmit the coded information of the noise frame. When both $J_1$ and $J_2$ are larger than 1, the output dtx_flag of the DTX decision is 1, which indicates that it is necessary to transmit the coded information of the noise frame. When $J_1$ and $J_2$ are not larger or smaller than 1 at the same time, $J=\alpha J_1+\beta J_2$ as shown in equation (4) is used as the DTX decision criterion.

When the coding is up to the ultrahigh-band, $J_1$, $J_2$ and $J_3$ are used as the DTX decision criteria. When $J_1$, $J_2$ and $J_3$ are all smaller than 1, the output dtx_flag of the DTX decision is 0, which indicates that it is not necessary to transmit the coded information of the noise frame. When $J_1$, $J_2$ and $J_3$ are all larger than 1, the output dtx_flag of the DTX decision is 1, which shows that it is necessary to transmit the coded information of the noise frame. When $J_1$, $J_2$ and $J_3$ are not larger or smaller than 1 at the same time, $J=\alpha J_1+\Phi_2+\gamma J_3$ as shown in equation (1) is used as the DTX decision criterion.

Both methods described above may be used for the DTX decision.

In the following, embodiments of the present disclosure will be described in detail with reference to specific application scenarios.

In Embodiment Two of the present disclosure, one of the DTX decision methods is described with reference to an example of performing DTX decision on the input wideband signal.

The structure of the SID frame used in this embodiment is shown in Table 1.

TABLE 1

Bits allocation of the SID frame

| Parameter description | Bits | Layer structure |
|---|---|---|
| Index of LSF parameter quantizer | 1 | Lower-band core |
| First stage vector of LSF quantization | 5 | layer |

TABLE 1-continued

| Bits allocation of the SID frame | | |
|---|---|---|
| Parameter description | Bits | Layer structure |
| Second stage vector of LSF quantization | 4 | |
| Quantized value of energy parameter | 5 | |
| Second stage quantized value of energy parameter | 3 | Lower-band enhancement layer |
| Third stage vector of LSF quantization | 6 | |
| Time envelope of wideband component | 6 | Higher-band core layer |
| Frequency envelope vector 1 of wideband component | 5 | |
| Frequency envelope vector 2 of wideband component | 5 | |
| Frequency envelope vector 3 of wideband component | 4 | |

The system operates at the sample rate of 16 k, and the input signal has a bandwidth of 8 kHz. A full-rate SID frame includes three layers, which are respectively the lower-band core layer, the lower-band enhancement layer and the higher-band core layer. The coding parameters used by the lower-band core layer are substantially the same to the coding parameters of SID frame according to Annex B of G.729, that is, 5 bits quantization of the energy parameter and 10 bits quantization of the spectrum parameter LSF. The lower-band enhancement layer is on the basis of the lower-band core layer, where the quantization error of the energy and spectrum parameters are further quantized. that is, it is performed the second stage quantization on the energy and the third stage quantization on the spectrum, in which 3 bits quantization are utilized for the second stage quantization of the energy and 6 bits quantization are utilized for the third stage quantization of the spectrum. The coding parameters used by the higher-band core layer are similar to those used in the TDBWE algorithm of G.729.1, but with the difference of reducing 16 points time envelope to 1 energy gain in time domain, which is processed by 6 bits quantization. There are still 12 frequency envelops, which are split into 3 vectors and quantized by using a total of 14 bits.

Firstly, the input signal is split into the lower-band and higher-band. The lower-band has a frequency range of 0~4 kHz and the higher-band has a frequency range of 4 kHz~8 kHz. Specifically, QMF filter bank is used to split the input signal $s_{WB}(n)$ having a sample rate of 16 kHz. The low-pass filter $H_1(z)$ is a symmetrical FIR filter with 64 taps, and the high-pass filter $H_2(z)$ may be deduced from $H_1(z)$, which is:

$$h_2(n)=(-1)^n h_1(n) \tag{5}$$

Therefore, the narrowband component may be obtained from equation (6):

$$y_l(n) = \sum_{j=0}^{31} h_1(j)[s_{WB}(n+1+j) + s_{WB}(n-j)] \tag{6}$$

And the wideband component may be obtained from equation (7):

$$y_h(n) = \sum_{j=0}^{31} h_2(j)[s_{WB}(n+1+j) + s_{WB}(n-j)] \tag{7}$$

LPC analysis is applied on the lower-band component $y_l(n)$ to arrive at LPC coefficients $\alpha_i$ (i=1 . . . M), where M is the order of LPC analysis, and the residual energy parameter is E. The quantized LPC coefficient $\alpha_{sid}^q(i)$ and quantized residual energy $E_{sid}^q$ of the last SID frame is saved in a buffer.

If the coding performed by an encoder is only up to the lower-band core layer or lower-band enhancement layer, then the DTX decision is performed only on the lower-band component.

Equation (8) is used to compute the variation $J_1$ for the lower-band:

$$J_1 = w_1 * \frac{|E_t^q - E_{sid}^q|}{thr1} + w_2 * \frac{\sum_{i=0}^{M} R_{sid}^q(i) \cdot R^t(i)}{E_t^q \cdot thr2} \tag{8}$$

where $w_1$, $w_2$ are respectively the weighting coefficients for the energy variation and spectrum variation; $E_t^q$, $E_{sid}^q$ respectively represent the quantized energy parameters of the current and the last SID frames; $R^t(i)$ is a self-correlation coefficient of the narrowband signal component of the current frame; thr1,thr2 are constant numbers and respectively present variation thresholds of the energy and spectrum parameters, wherein the variation thresholds reflect the sensitiveness of human ear to the energy and spectrum variation; M is the order of linear prediction; $R_{sid}^q(i)$ is computed from the quantized LPC coefficient of the last SID frame according to equation (9):

$$\begin{cases} R_{sid}^q(j) = 2\sum_{k=0}^{M-j} a_{sid}^q(k) \times a_{sid}^q(k+j), & j \neq 0 \\ R_{sid}^q(0) = \sum_{k=0}^{M} (a_{sid}^q(k))^2, & j = 0 \end{cases} \tag{9}$$

Therefore, the variation of the lower-band signal may be computed from equation (8) and the DTX decision result may be obtained by using equations (3) and (2).

In the embodiment, the parameters used by the lower-band core layer and lower-band enhancement layer are exactly the same, and the parameters of the enhancement layer are obtained by further quantizing the parameters of the core layer. Therefore, if the coding rate is up to the lower-band enhancement layer, the DTX decision procedure is substantially identical to equation (8) and (9), except for the used energy and spectrum parameters being the quantized result in the enhancement layer. The decision procedure will not be repeated here.

If the coding performed by the encoder is up to the higher-band core layer, then the variation $J_2$ for the wideband has to be computed in addition to computing $J_1$ according to equation (8). For the wideband part, the simplified TDBWE encoding algorithm is used to extract and code the time envelope and frequency envelope of the wideband signal component. The time envelope is computed by using equation (10):

$$T_{env} = \frac{1}{2}\log_2 \sum_{n=0}^{N-1} y_h(n)^2 \tag{10}$$

where N is the frame length, and N=160 in G.729.1

The frequency envelope may be computed by using equations (11), (12), (13) and (14). Firstly, a Hamming window with 128 taps is used to window the wideband signal. The window function is expressed as equation (11):

$$w_F(n) = \begin{cases} \frac{1}{2}\left(1 - \cos\left(\frac{2\pi n}{143}\right)\right), & n = 0, \ldots, 71 \\ \frac{1}{2}\left(1 - \cos\left(\frac{2\pi(n-16)}{111}\right)\right), & n = 72, \ldots, 127 \end{cases} \tag{11}$$

The windowed signal is:

$$y_h^w(n) = y_h(n) \sim w_F(n+31),\ n = -31, \ldots, 96 \tag{12}$$

A 128 points FFT is performed on the windowed signal, which is implemented using a polyphase structure:

$$Y_h^{fft}(k) = FFT_{64}(y_h^w(n) + y_h^w(n+64)),\ k = 0, \ldots, 63;\ n = -31, \ldots, 32 \tag{13}$$

The weighted frequency envelope is obtained using the computed FFT coefficients:

$$F_{env}(j) = \frac{1}{2}\log_2\left(\sum_{k=2j}^{2(j+1)} W_F(k-2j) \cdot \left|S_{HB}^{fft}(k)\right|^2\right),\ j = 0, \ldots, 11 \tag{14}$$

The quantized time envelope $Tenv_{sid}^q$ and frequency envelope $Fenv_{sid}^q(j)$ of the last SID frame is buffered in the memory. Thus, the variation between the wideband components of the current frame and the last SID frame may be computed from equations (15a) or (15b):

$$J_2 = w_3 * \frac{|T_{env} - Tenv_{sid}^q|}{thr3} + w_4 * \frac{\sum_{i=0}^{11} F_{env}(i) \cdot Fenv_{sid}^q(i)}{thr4} \tag{15a}$$

$$J_2 = w_3 * \frac{|T_{env} - Tenv_{sid}^q|}{thr3} + w_4 * \frac{\sum_{i=0}^{11} |F_{env}(i) - Fenv_{sid}^q(i)|}{thr4} \tag{15b}$$

After the narrowband variation $J_1$ and wideband variation $J_2$ are respectively obtained, the combined variation of the narrowband and wideband may be computed using equation (4). Next, it may be determined whether it is necessary for the current frame to encode and transmit the SID frame according to the decision rule shown in equation (2).

In Embodiment Three of the present disclosure, one of the DTX decision methods is described with reference to an example of making the DTX decision on the input ultra-wideband signal.

The signal processed in the embodiment is sampled at 32 kHz and band-split into lower-band, higher-band and ultra-high-band noise components. The band-splitting may be performed in a tree-like hierarchical structure, that is, the signal is split into ultrahigh-band and wideband signal through one QMF, and the wideband signal is then split into the lower-band and higher band signal through another QMF. The input signal can also be directly split into the lower-band, higher-band and ultrahigh-band signal components by using a variable bandwidth sub-band filter bank. Obviously, a band-splitter with tree-like hierarchical structure has better scalability. Narrowband and wideband information obtained via the splitting may be input to the system of Embodiment Two for wideband DTX decision. The variation metric J of the characteristic information of the wideband noise as shown in equation (4) may be finally obtained. That is, in this embodiment, the variation metric Ja of the characteristic of the full-band noise may be obtained by combining the variation Js of the characteristic information of the ultra-wideband noise and that of the wideband noise, which is expressed in equation (16):

$$J_a = \gamma \cdot J + \xi J_s \tag{16}$$

The DTX decision is performed based on the variation metric Ja of the characteristic of the full band noise, in order to output the full-band DTX decision result dtx_flag, which is expressed in equation (17):

$$\begin{cases} \text{dtx_flag} = 1 & J_a > 1 \\ \text{dtx_flag} = 0 & J_a \le 1 \end{cases} \tag{17}$$

where $\delta + \xi = 1$.

The variation metric Js of the characteristic of ultrahigh-band noise will be described in the following. The structure of the lower-band and higher-band part of the SID frame used in the embodiment is as shown in Table 1 and will not be repeated here. The structure of the ultrahigh-band is as shown in Table 2:

TABLE 2

Ultrahigh-band bits allocation of the SID frame

| Parameter description | Bits | Layer structure |
|---|---|---|
| Time envelope of ultrahigh-band component | 6 | Ultrahigh-band core layer |
| Frequency envelope vector 1 of ultrahigh-band component | 5 | |
| Frequency envelope vector 2 of ultrahigh-band component | 5 | |
| Frequency envelope vector 3 of ultrahigh-band component | 4 | |

The energy envelope of the ultrahigh-band signal in time domain is computed from equation (19):

$$T_{env} = \frac{1}{2}\log_2\left(\sum_{n=0}^{N-1} y_s(n)^2\right) \tag{19}$$

where N is 320 when the processed frame is 20 ms, ys is the ultrahigh-band signal. The computation of the frequency envelope $Fenv_s(j)$ is similar to that for the higher-band, but with the difference of having a different frequency width, which means the points of frequency envelope may be different as well. $Fenv_s(j)$ may be expressed in equation (20):

$$Fenv_s = \frac{1}{2}\log_2\left(\sum_{k=20\cdot j}^{20\cdot j+19} W_F^s(k-20\cdot j)\cdot|Y_s(k)|^2\right) \quad (20)$$

where Ys is the ultrahigh-band spectrum, which may be computed using Fast Fourier Transform (FFT) or Modified Discrete Cosine Transform (MDCF). In the example of equation (20), the spectrum has a frequency width of 320 points and the computed frequency envelope has 280 frequency points in the range of 8 kHz to 14 kHz. For the sake of quantization, the frequency envelope may still be split into three sub-vectors.

The quantized time envelope $Tenv_{sid}^{q}$ and frequency envelope $Fenv_{sid}^{q}(j)$ of ultrahigh-band for the last SID frame is buffered in the memory, and thus the variation between the ultrahigh-band components of the current frame and the last SID frame may be computed by using equations (21a) or (21b)

$$J_s = w_5 * \frac{\left|T_{env}^s - Tenv_{sid}^{s(q)}\right|}{thr5} + w_6 * \frac{\sum_{i=0}^{11} F_{env}^s(i)\cdot Fenv_{sid}^{s(q)}(i)}{thr6} \quad (21a)$$

or:

$$J_s = w_5 * \frac{\left|T_{env}^s - Tenv_{sid}^{s(q)}\right|}{thr5} + w_6 * \frac{\sum_{i=0}^{11} \left|F_{env}^s(i) - Fenv_{sid}^{s(q)}(i)\right|}{thr6} \quad (21b)$$

Then, the variation metric of the characteristic of the full-band noise may be computed using equation (16). Subsequently, it may be determined whether it is necessary for the current frame to encode and transmit the SID frame according to the decision rule as shown in equation (17).

As described above, the first DTX decision method described at block s103 of Embodiment One are used in the DTX decision procedures for both Embodiment Two and Embodiment Three. The second DTX decision method described at block s103 of Embodiment One may also be used in Embodiments Two and Three, and the detailed decision procedure is similar to that described in Embodiments Two and Three, which will not be described here again.

In Embodiment Four of the present disclosure, one of the DTX decision methods is described with reference to an example of making the DTX decision on the input wideband signal.

The structure of the SID frame used in the embodiment is shown in Table 3.

TABLE 3

Bits allocation of the SID frame

| Parameter description | Bits | Layer structure |
|---|---|---|
| Index of LSF parameter quantizer | 1 | Lower-band core layer |
| First stage vector of LSF quantization | 5 | |
| Second stage vector of LSF quantization | 4 | |
| Quantized value of energy parameter | 5 | |
| Second stage quantized value of energy parameter | 3 | Lower-band enhancement layer |
| Third stage vector of LSF quantization | 6 | |
| Time envelope of wideband component | 6 | Higher-band core layer |

TABLE 3-continued

Bits allocation of the SID frame

| Parameter description | Bits | Layer structure |
|---|---|---|
| Frequency envelope vector 1 of wideband component | 5 | |
| Frequency envelope vector 2 of wideband component | 5 | |
| Frequency envelope vector 3 of wideband component | 4 | |

The system operates at the sample rate of 16 k, and the input signal has a bandwidth of 8 kHz. A full-rate SID frame includes three layers, which are respectively the lower-band core layer, the lower-band enhancement layer and the higher-band core layer. The coding parameters used by the lower-band core layer are substantially the same to the coding parameters of SID frame as shown in Annex B of G.729, that is, 5 bits quantization of the energy parameter and 10 bits quantization of the spectrum parameter LSF. The lower-band enhancement layer is based on the lower-band core layer, where the quantization error of the energy and spectrum parameters are further quantized. That is, it is performed the second stage quantization on the energy and third stage quantization on the spectrum, in which 3 bits quantization is used for the second stage quantization of the energy, and 6 bits quantization is used for the third stage quantization of the spectrum. The coding parameters used by the higher-band core layer are similar to those used in the TDBWE algorithm of G.729.1, but with the difference of reducing 16 points time envelope to 1 energy gain in time domain, which is quantized by using 6 bits. There are still 12 frequency envelopes, which are split into 3 vectors and quantized using a total of 14 bits.

Firstly, the input signal is split into the lower-band and higher-band. The lower-band has a frequency range of 0 to 4 kHz and the higher-band has a frequency range of 4 kHz to 8 kHz. Specifically, QMF filter bank is used to split the input signal $s^{WB}(n)$ with a 16 kHz sample rate. The low pass filter $H_1(z)$ is a symmetrical FIR filter with 64 taps, and the high pass filter $H_2(z)$ may be deduced from $H_1(z)$, which is:

$$h_2(n)=(-1)^n h_1(n) \quad (22)$$

Therefore, the narrowband component may be obtained from equation (23):

$$y_l(n) = \sum_{j=0}^{31} h_1(j)[s_{WB}(n+1+j)+s_{WB}(n-j)] \quad (23)$$

And the wideband component may be obtained from equation (24):

$$y_h(n) = \sum_{j=0}^{31} h_2(j)[s_{WB}(n+1+j)+s_{WB}(n-j)] \quad (24)$$

LPC analysis is applied on the lower-band component $y_l(n)$ to arrive at LPC coefficients $\alpha_i$ (i=1 . . . M), where M is the order of LPC analysis, and the residual energy parameter is E. The quantized LPC coefficient $\alpha_{sid}^{q}(i)$ and quantized residual energy $E_{sid}^{q}$ of the last SID frame is saved in the buffer.

If the coding performed by the encoder is only up to the lower-band core layer and lower-band enhancement layer, then the DTX decision is performed only on the lower-band component.

Equation (25) is used to obtain the DTX decision result of the lower-band component:

$$\text{dtx_nb} = \begin{cases} 1 & |E_t^q - E_{sid}^q| > thr1 \text{ or } \sum_{i=0}^{M} R_{sid}^q(i) \cdot R^t(i) > E_t^q \cdot thr2 \\ 0 & \text{others} \end{cases} \quad (25)$$

where $w_1$, $w_2$ are respectively the weighting coefficients for the energy variation and spectrum variation; $E_t^q$, $E_{sid}^q$ respectively represent the quantized energy parameters of the current frame and the last SID frame. If the current coding rate is only for the lower-band core layer, then the quantization result of the lower-band core layer is used. If the current coding rate is for the lower-band enhancement layer or higher layers, then the quantization result of the enhancement layer is used. $R^t(i)$ is a self-correlation coefficient of the narrow-band signal component of the current frame; thr1,thr2 are constant numbers and respectively represent variation thresholds of the energy parameter and spectrum parameter, which reflect the sensitiveness of human ear to the energy and spectrum variations; M is the order of linear prediction; $R_{sid}^q(i)$ is computed from the quantized LPC coefficients of the last SID frame according to equation (26):

$$\begin{cases} R_{sid}^q(j) = 2\sum_{k=0}^{M-j} a_{sid}^q(k) \times a_{sid}^q(k+j), & j \neq 0 \\ R_{sid}^q(0) = \sum_{k=0}^{M} (a_{sid}^q(k))^2, & j = 0 \end{cases} \quad (26)$$

If the coding performed by the encoder is up to the higher-band core layer, then for the wideband part, the simplified TDBWE encoding algorithm is used to extract and encode the time envelope and frequency envelope of the wideband signal component. Here, the time envelope is computed using equation (27):

$$T_{env} = \frac{1}{2}\log_2 \sum_{n=0}^{N-1} y_h(n)^2 \quad (27)$$

where N is the frame length, and N=160 in G.729.1

The frequency envelope is computed using equations (28), (29), (30) and (31). Firstly, a Hamming window with 128 taps is used to window the wideband signal. The window function is expressed as equation (28):

$$w_F(n) = \begin{cases} \frac{1}{2}\left(1 - \cos\left(\frac{2\pi n}{143}\right)\right), & n = 0, \ldots, 71 \\ \frac{1}{2}\left(1 - \cos\left(\frac{2\pi(n-16)}{111}\right)\right), & n = 72, \ldots, 127 \end{cases} \quad (28)$$

The windowed signal is:

$$y_h^w(n) = y_h(n) \cdot w_F(n+31),\ n = -31, \ldots, 96 \quad (29)$$

A 128 points FFT is performed on the windowed signal, which is implemented using a polynomial structure:

$$Y_h^{fft}(k) = FFT_{64}(y_h^w(n) + y_h^w(n+64)),\ k = 0, \ldots, 63;\ n = -31, \ldots, 32 \quad (30)$$

The weighted frequency envelope is obtained by using the computed FFT coefficients:

$$F_{env}(j) = \frac{1}{2}\log_2\left(\sum_{k=2j}^{2(j+1)} W_F(k-2j) \cdot \left|S_{HB}^{fft}(k)\right|^2\right),\ j = 0, \ldots, 11 \quad (31)$$

The short-time time envelope $Tenv_{st}$ and frequency envelope $Fenv_{st}(i)$ of the noise signal is buffered in the memory, and thus the short-time DTX decision on the wideband component of the current frame may be given in equation (32):

$$\text{dtx_wb}_{st} = \begin{cases} 1 & |Tenv - Tenv_{st}| > thr3 \text{ or } \sum_{i=0}^{11} \left| Fenv(i) - Fenv_{st}(i) \right| > thr4 \\ 0 & \text{others} \end{cases} \quad (32)$$

The short-time time envelope is updated according to the following equation:

$$Tenv_{st} = \rho \times Tenv_{st} + (1-\rho) \times Tenv$$

The short-time frequency envelope is updated according to the following equation:

$$Fenv_{st}(i) = \rho \times Fenv_{st}(i) + (1-\rho) \times Fenv(i)$$

The long-time time envelope $Tenv_{lt}$ hand frequency envelope $Fenv_{lt}(i)$ of the noise signal is also buffered in the memory, and thus the long-time DTX decision on the wideband component of the current frame may be given in equation (33):

$$\text{dtx_wb}_{lt} = \begin{cases} 1 & |Tenv - Tenv_{lt}| > thr5 \text{ or } \sum_{i=0}^{11} \left| Fenv(i) - Fenv_{lt}(i) \right| > thr6 \\ 0 & \text{others} \end{cases} \quad (33)$$

After obtaining short-time DTX decision and long-time DTX decision of the wideband component, the synthesized decision of the wideband component is obtained using the following equation:

$$\text{dtx_wb} = \begin{cases} 1 & \text{dtx_wb}_{st} + \text{dtx_wb}_{lt} > 0 \\ 0 & \text{dtx_wb}_{st} + \text{dtx_wb}_{lt} = 0 \end{cases}$$

When dtx_wb=1, the long-time time envelop is updated according to the following equation:

$$Tenv_{lt} = \psi \times Tenv_{lt} + (1-\psi) \times Tenv$$

The long-time frequency envelop is updated according to the following equation:

$$Fenv_{lt}(i) = \psi \times Fenv_{lt}(i) + (1-\psi) \times Fenv(i)$$

If dtx_wb=dtx_nb, then dtx_flag=dtx_wb=dtx_nb; otherwise, synthesis decision is requested, which is specifically described as follows.

First, variation $J_1$ for the lower-band is computed using equation (8), then variation $J_2$ for the higher-band is computed using equation (15a) or (15b). The combined variation J for both the lower-band and higher-band is then computed using equation (4). Finally, the final DTX decision result dtx_flat is decided using the decision rule of equation (2).

In this embodiment, the second DTX decision method described in the Embodiment One can also be used. Specifically, independent decisions are separately made for the lower-band and higher-band. If the two independent decision results are not the same, then the combined decision using the variations of the characteristic parameters of both the lower-band and higher-band is made to correct the independent decision results.

The methods provided by the above embodiments make full use of the noise characteristic in the speech encoding/decoding bandwidth and give complete and appreciate DTX decision results at the noise encoding stage by using band-splitting and layered processing. As a result, the SID encoding/CNG decoding closely follows the characteristic variation of the actual noise.

The Embodiment Five of the present disclosure provides a DTX decision device as shown in FIG. 3, which includes the following modules:

A band-splitting module 10 is configured to obtain the sub-band signals by splitting the input signal. A QMF filter bank may be used to split the input signal having a specific sample rate. When the signal is a narrowband signal, the sub-band signal is a lower-band signal, which further includes a lower-band core layer signal or a lower-band core layer signal and a lower-band enhancement layer signal. When the signal is a wideband signal, the sub-band signals are a lower-band signal and a higher-band signal, the lower band signal further includes a lower-band core layer signal and a lower-band enhancement layer signal and the higher-band signal further includes a higher-band core layer signal or a higher-band core layer signal and a higher-band enhancement layer signal. When the signal is an ultra-wideband signal, the sub-band signals are a lower-band signal, higher-band signal and an ultrahigh-band signal; the lower band signal further includes a lower-band core layer signal and a lower-band enhancement layer signal, the higher-band signal further includes a higher-band core layer signal and a higher-band enhancement layer signal.

A characteristic information variation obtaining module 20 is configured to obtain the variation of the characteristic information of each sub-band signal, after the band-splitting is done by the band-splitting module.

A decision module 30 is configured to make the DTX decision according to the variation of the characteristic information of each sub-band signal obtained by the characteristic information variation obtaining module 20. The decision module 30 further includes: a weighting decision sub-module 31, configured to weight the variation of the characteristic information of each sub-band signal obtained by the characteristic information variation obtaining module 20 and make a combined decision on the weighted results as the DTX decision criterion; and a sub-band decision sub-module 32, configured to take the variation of the characteristic information of each sub-band signal obtained by the characteristic information variation obtaining module 20 as the decision criterion for the sub-band signal; wherein the sub-band decision sub-module may take the decision result as the DTX decision criterion when the decision results for different sub-bands are the same; and inform the weighting decision sub-module to make the combined decision when the decision results for different sub-bands are not the same.

Specifically, the structure of the characteristic information variation obtaining module 20 varies according to the different signals that are processed.

When the lower-band signal is processed, the characteristic information variation obtaining module 20 further includes a lower-band characteristic information variation obtaining sub-module 21, which is configured to obtain the variation of characteristic information of the lower-band signal. Specifically, a linear prediction analysis model is used to obtain the characteristic information of the lower-band signal, which includes energy information and spectrum information of the lower-band signal. The variation of the characteristic information of the lower-band signal is obtained according to the characteristic information at the current time and that at the previous time.

When the wideband signal is processed, the characteristic information variation obtaining module 20 further includes: a lower-band characteristic information variation obtaining sub-module 21, configured to obtain the variation of the characteristic information of the lower-band signal; a higher-band characteristic information variation obtaining sub-module 22, configured to obtain the variation of the characteristic information of the higher-band signal. Specifically, Time Domain Band Width Extension (TDBWE) encoding algorithm is used to obtain characteristic information of the higher-band signal, which includes time envelope information and frequency envelope information of the higher-band signal. The variation of the characteristic information of the higher-band signal is obtained according to the characteristic information of the higher-band signal at the current time and that at the previous time.

When the ultra-wideband signal is processed, the characteristic information variation obtaining module 20 further includes: a lower-band characteristic information variation obtaining sub-module 21, configured to obtain the variation of the characteristic information of the lower-band signal; a higher-band characteristic information variation obtaining sub-module 22, configured to obtain the variation of the characteristic information for the higher-band signal; an ultra-high-band characteristic information variation obtaining module 23, configured to obtain the variation of the characteristic information of the ultrahigh-band signal. Specifically, Time Domain Band Width Extension (TDBWE) encoding algorithm is used to obtain characteristic information of the ultrahigh-band signal, which includes time envelope information and frequency envelope information of the ultrahigh-band signal. The variation of the characteristic information of the ultrahigh-band signal is obtained according to the characteristic information of the ultrahigh-band signal at the current time and that at the previous time.

Figure 4:
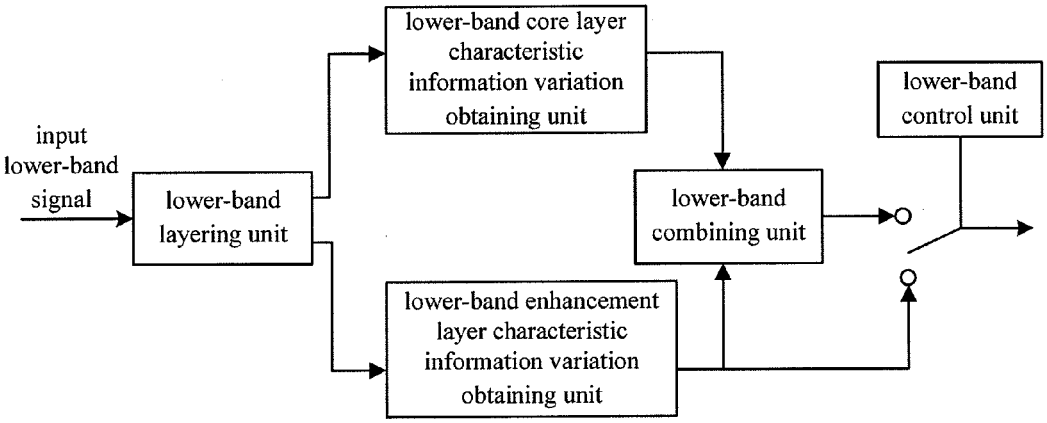
FIG. 4 is a block diagram of a lower-band characteristic information variation obtaining sub-module in the DTX decision device according to Embodiment Five of the present disclosure.

Specifically, when the lower-band signal further includes the lower-band core layer signal and lower-band enhancement layer signal, the structure of the lower-band characteristic information variation obtaining sub-module 21 is shown in FIG. 4. The lower-band characteristic information variation obtaining sub-module 21 further includes: a lower-band layering unit, a lower-band core layer characteristic information variation obtaining unit, a lower-band enhancement layer characteristic information variation obtaining unit, a lower-band synthesizing unit, and a lower-band control unit.

The lower-band layering unit is configured to divide the input lower-band signal into a lower-band core layer signal and a lower-band enhancement layer signal, and to transmit the lower-band core layer signal and lower-band enhancement layer signal respectively to a lower-band core layer characteristic information variation obtaining unit and a lower-band enhancement layer characteristic information variation obtaining unit.

The lower-band core layer characteristic information variation obtaining unit is configured to obtain the variation of the characteristic information of the lower-band core layer signal.

The lower-band enhancement layer characteristic information variation obtaining unit is configured to obtain the variation of the characteristic information of the lower-band enhancement layer signal.

The lower-band synthesizing unit is configured to synthesize the variation of the characteristic information of the lower-band core layer signal obtained by the lower-band core layer characteristic information variation obtaining unit and the variation of the characteristic information of the lower-band enhancement layer signal obtained by the lower-band enhancement layer characteristic information variation obtaining unit, as the variation of the characteristic information variation for the lower band.

The lower-band control unit is configured to take the output of the lower-band core layer decision sub-module as the variation of the characteristic information of the lower band signal when the lower-band signal involves only the lower-band core layer; and to take the output of the lower-band synthesizing unit as the variation of the characteristic information of the lower band signal when the sub-band signal is up to the lower-band enhancement layer.

Specifically, when the higher-band signal further includes the higher-band core layer signal and higher-band enhancement layer signal, the structure of the higher-band characteristic information variation obtaining module 22 is similar to that of the lower-band characteristic information variation obtaining module 21 as shown in FIG. 4. The higher-band characteristic information variation obtaining module 22 further includes: a higher-band layering unit, a higher-band core layer characteristic information variation obtaining unit, higher-band enhancement layer characteristic information variation obtaining unit, a higher-band synthesizing unit, and a higher-band control unit.

The higher-band layering unit is configured to divide the input higher-band signal into a higher-band core layer signal and a higher-band enhancement layer signal, and to transmit the higher-band core layer signal and higher-band enhancement layer signal respectively to a higher-band core layer characteristic information variation obtaining unit and a higher-band enhancement layer characteristic information variation obtaining unit.

The higher-band core layer characteristic information variation obtaining unit is configured to obtain the variation of the characteristic information of the higher-band core layer signal.

The higher-band enhancement layer characteristic information variation obtaining unit is configured to obtain the variation of the characteristic information of the higher-band enhancement layer signal.

The higher-band synthesizing unit is configured to synthesize the variation of the characteristic information of the higher-band core layer signal obtained by the higher-band core layer characteristic information variation obtaining unit and the variation of the characteristic information of the higher-band enhancement layer signal obtained by the higher-band enhancement layer characteristic information variation obtaining unit, as the variation of the characteristic information for the higher band.

The higher-band control unit is configured to take the output of the higher-band core layer decision sub-module as the variation of the characteristic information of the higher band signal when the higher-band signal involves only the higher-band core layer; to take the output of the higher-band synthesizing unit as the variation of the characteristic information of the higher band signal when the sub-band signal is up to the higher-band enhancement layer.

Figure 5:
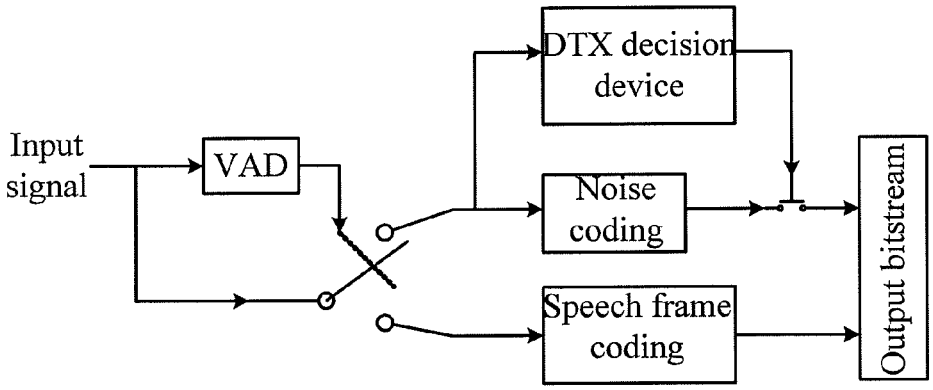
FIG. 5 is a schematic diagram of an application scenario of the DTX decision device according to Embodiment Five of the present disclosure.

An application scenario using the DTX decision device shown in FIG. 3 is illustrated in FIG. 5, in which, the input signal is determined to be a speech frame or silence frame (background noise frame) via the VAD. For the speech frame, speech frame coding is performed along the lower path to output a speech frame bitstream. For the silence frame (background noise frame), noise coding is performed along the upper path, in which the DTX decision device provided by the Embodiment Four of the present disclosure is used to determine whether the encoder should encode and transmit the current noise frame.

Figure 6:
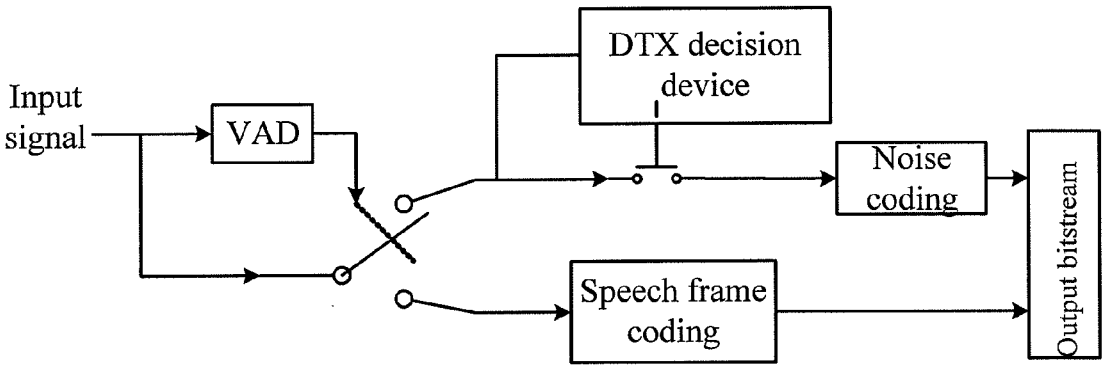
FIG. 6 is a schematic diagram of another application scenario of the DTX decision device according to Embodiment Five of the present disclosure.

Another application scenario of the DTX decision device as shown in FIG. 3 is illustrated in FIG. 6, in which, the input signal is determined to be a speech frame or silence frame (background noise frame) via the VAD. For the speech frame, speech frame coding is performed along the lower path to output a speech frame bitstream. For the silence frame (background noise frame), noise coding is performed along the upper path, in which the DTX decision device provided by the fourth embodiment of the invention is used to determine whether the encoder should transmit the encoded noise frame.

The devices provided by the above embodiments make full use of the noise characteristic in the speech encoding/decoding bandwidth and give the complete and appreciate DTX decision result at the noise encoding stage, by using band-splitting and layer processing. As a result, the SID encoding/CNG decoding may closely follow the characteristic variation of the actual noise.

Based on the above description of the embodiments, those skilled in the art can thoroughly understand the present disclosure, which may be realized through hardware or the combination of software and the necessary general hardware platform. Thus, the technical solution of the present disclosure may be embodied in a software product, which may be stored on a non-volatile storage medium (such as CD-ROM, flash memory and removable disk) and include instructions that make a computing device (such as a personal computer, a server or a network device) to execute the methods according to the embodiments of the present disclosure.

In summary, what described above are only exemplary embodiments of the disclosure, and are not intended to limit the scope of the disclosure. Any modification, equivalent substitution and improvement within the spirit and scope of the disclosure are intended to be included in the scope of the disclosure.

What is claimed is:

1. A method for discontinuous transmission (DTX) decision, comprising:

obtaining sub-band signal(s) by splitting input signal;

obtaining a variation of characteristic information of each of the sub-band signal(s), wherein the variation of characteristic information is a variation value of the obtained characteristic information of the signal within each of the sub-band compared with the characteristic information of the signal within the sub-band obtained at a past time;

performing a combined decision on the variation of the characteristic information of each of the sub-band signals and taking a result of the combined decision as a DTX decision criterion;

if the result is larger than a threshold, it is determined a Silence Insertion Descriptor (SID) frame be transmitted;

otherwise, it is determined that it is unnecessary to transmit the SID frame;

wherein, variation of characteristic information of a ultra-high-band signal that falls within sub-band signals at the past time is calculated by the following formula:

$$J_s = w_5 * \frac{|T_{env}^s - Tenv_{sid}^{s(q)}|}{thr5} + w_6 * \frac{\sum_{i=0}^{11} |F_{env}^s(i) - Fenv_{sid}^{s(q)}(i)|}{thr6}$$

where, the Js is variation metric of the characteristic information of the ultrahigh-band signal; the $Tenv_{sid}^{s(q)}$ is quantized time envelope of the ultrahigh-band signal for a last SID frame of the ultrahigh-band signal within the sub-band signals at the past time, and the $Fenv_{sid}^{s(q)}(i)$ is a frequency envelope of the ultrahigh-band signal for the last SID frame of the ultrahigh-band signal within the sub-band signals at the past time; the $T_{env}^s$ is the time envelop of the ultrahigh-band signal within the sub-band signals, and the $F_{env}^s(i)$ is the frequency envelop of the ultrahigh-band signal within the sub-band signals; $w_5$ and $w_6$ are respectively weighting coefficients for energy variation $|T_{env}^s - Tenv_{sid}^{s(q)}|$ and spectrum variation $|F_{env}^s(i) - Fenv_{sid}^{s(q)}(i)|$; thr5 and thr6 are constant numbers.

2. A discontinuous transmission (DTX) decision device incorporated in a hardware-based audio coder, comprising:

a band-splitting module of the hardware-based audio coder, configured to receive input signal(s) and obtain sub-band signal(s) by splitting the input signal(s);

a characteristic information variation obtaining module of the hardware-based audio coder, configured to receive the sub-band signal(s) from the band-splitting module and obtain a variation of characteristic information of each of the sub-band signals, wherein the variation of characteristic information is a variation value of the obtained characteristic information of the signal within each of the sub-bands compared with the characteristic information of the signal within the sub-band obtained at a past time;

a decision module of the hardware-based audio coder, configured to receive the variation of characteristic information, perform a combined decision on the variation of the characteristic information of each of the sub-band signals and taking a result of the combined decision as a DTX decision criterion;

if the result is larger than a threshold, it is determined that an Silence Insertion Descriptor (SID) frame should be transmitted; otherwise, it is determined that it is unnecessary to transmit the SID frame; and to output the DTX decision criterion;

wherein, variation of characteristic information of a ultrahigh-band signal that falls within sub-band signals at the past time is obtained by the characteristic information variation obtaining module through the following formula:

$$J_s = w_5 * \frac{|T_{env}^s - Tenv_{sid}^{s(q)}|}{thr5} + w_6 * \frac{\sum_{i=0}^{11} |F_{env}^s(i) - Fenv_{sid}^{s(q)}(i)|}{thr6}$$

where, the Js is variation metric of the characteristic information of the ultrahigh-band signal; the $Tenv_{sid}^{s(q)}$ quantized time envelope of the ultrahigh-band signal for a last SID frame of the ultrahigh-band signal within the sub-band signals at the past time, and the $Fenv_{sid}^{s(q)}$ (i) is a frequency envelope of the ultrahigh-band signal for the last SID frame of the ultrahigh-band signal within the sub-band signals at the past time; the $T_{env}^s$ is the time envelop of the ultrahigh-band signal within the sub-band signals, and the $F_{env}^s(i)$ is the frequency envelop of the ultrahigh-band signal within the sub-band signals, $w_5$ and $w_6$ are respectively weighting coefficients for energy variation $|T_{env}^s - Tenv_{sid}^{s(q)}|$ and spectrum variation $|F_{env}^s(i) - Fenv_{sid}^{s(q)}(i)|$; thr5 and thr6 are constant numbers.

3. A discontinuous transmission (DTX) decision device incorporated in a hardware-based audio coder, comprising:

a band-splitting module of the hardware-based audio coder, configured to receive input signal(s) and obtain sub-band signal(s) by splitting the input signal(s);

a characteristic information variation obtaining module of the hardware-based audio coder, configured to receive the sub-band signal(s) from the band-splitting module and obtain a variation of characteristic information of each of the sub-band signals, wherein the variation of characteristic information is a variation value of the obtained characteristic information of the signal within each of the sub-bands compared with the characteristic information of the signal within the sub-band obtained at a past time;

a decision module of the hardware-based audio coder, configured to receive the variation of characteristic information, perform a combined decision on the variation of the characteristic information of each of the sub-band signals and taking a result of the combined decision as a DTX decision criterion; if the result is larger than a threshold, it is determined that an Silence Insertion Descriptor (SID) frame should be transmitted; otherwise, it is determined that it is unnecessary to transmit the SID frame; and to output the DTX decision criterion; and wherein, the characteristic information variation obtaining module further comprises:

a lower-band characteristic information variation obtaining sub-module, configured to obtain variation of characteristic information of a lower-band signal;

the lower-band characteristic information variation obtaining sub-module further comprises:

a lower-band layering unit, configured to divide the input lower-band signal into a lower-band core layer signal and a lower-band enhancement layer signal, and to transmit the lower-band core layer signal and lower-band enhancement layer signal respectively to a lower-band core layer characteristic information variation obtaining unit and a lower-band enhancement layer characteristic information variation obtaining unit;

the lower-band core layer characteristic information variation obtaining unit, configured to obtain variation of characteristic information of the lower-band core layer signal;

the lower-band enhancement layer characteristic information variation obtaining unit;

configured to obtain variation of characteristic information of the lower-band enhancement layer signal;

a lower-band synthesizing unit, configured to synthesize the variation of the characteristic information of the lower-band core layer signal obtained by the lower-band core layer characteristic information variation obtaining unit and the variation of the characteristic information of the lower-band enhancement layer signal obtained by the lower-band enhancement layer characteristic information variation obtaining unit, as the variation of the characteristic information for the lower band; and a lower-band control unit, configured to take an output of a lower-band core layer decision sub-module as the variation of the characteristic information of the lower band signal when the lower-band signal involves only the lower-band core layer; and to take the output of the lower-band synthesizing unit as the variation of the characteristic information of the lower band signal when the sub-band signal is up to the lower-band enhancement layer.

4. A discontinuous transmission (DTX) decision device incorporated in a hardware-based audio coder, comprising:

a band-splitting module of the hardware-based audio coder, configured to receive input signal(s) and obtain sub-band signal(s) by splitting the input signal(s);

a characteristic information variation obtaining module of the hardware-based audio coder, configured to receive the sub-band signal(s) from the band-splitting module and obtain a variation of characteristic information of each of the sub-band signals, wherein the variation of characteristic information is a variation value of the obtained characteristic information of the signal within each of the sub-bands compared with the characteristic information of the signal within the sub-band obtained at a past time; and a decision module of the hardware-based audio coder, configured to receive the variation of characteristic information, perform a combined decision on the variation of the characteristic information of each of the sub-band signals and taking a result of the combined decision as a DTX decision criterion; if the result is larger than a threshold, it is determined that an Silence Insertion Descriptor (SID) frame should be transmitted; otherwise, it is determined that it is unnecessary to transmit the SID frame; and to output the DTX decision criterion; and wherein, the characteristic information variation obtaining module further comprises:

a lower-band characteristic information variation obtaining sub-module, configured to obtain variation of characteristic information of a lower-band signal;

the higher-band characteristic information variation obtaining sub-module further comprises:

a higher-band layering unit, configured to divide the input higher-band signal into a higher-band core layer signal and a higher-band enhancement layer signal, and to transmit the higher-band core layer signal and higher-band enhancement layer signal respectively to a higher-band core layer characteristic information variation obtaining unit and a higher-band enhancement layer characteristic information variation obtaining unit;

the higher-band core layer characteristic information variation obtaining unit, configured to obtain variation of characteristic information of the higher-band core layer signal;

the higher-band enhancement layer characteristic information variation obtaining unit, configured to obtain variation of characteristic information of the higher-band enhancement layer signal;

a higher-band synthesizing unit, configured to synthesize the variation of the characteristic information of the higher-band core layer signal obtained by the higher-band core layer characteristic information variation obtaining unit and the variation of the characteristic information of the higher-band enhancement layer signal obtained by the higher-band enhancement layer characteristic information variation obtaining unit, as the variation of characteristic information for the higher band; and a higher-band control unit, configured to take an output of a higher-band core layer decision sub-module as the variation of the characteristic information of the higher band signal when the higher-band signal involves only the higher-band core layer; to take the output of the higher-band synthesizing unit as the variation of the characteristic information of the higher band signal when the sub-band signal is up to the higher-band enhancement layer.

5. A discontinuous transmission (DTX) decision device incorporated in a hardware-based audio coder, comprising:

a band-splitting module of the hardware-based audio coder, configured to receive input signal(s) and obtain sub-band signal(s) by splitting the input signal(s);

a characteristic information variation obtaining module of the hardware-based audio coder, configured to receive the sub-band signal(s) from the band-splitting module and obtain a variation of characteristic information of each of the sub-band signals, wherein the variation of characteristic information is a variation value of the obtained characteristic information of the signal within each of the sub-bands compared with the characteristic information of the signal within the sub-band obtained at a past time;

a decision module of the hardware-based audio coder, configured to receive the variation of characteristic information, perform a combined decision on the variation of the characteristic information of each of the sub-band signals and taking a result of the combined decision as a DTX decision criterion; if the result is larger than a threshold, it is determined that an Silence Insertion Descriptor (SID) frame be transmitted; otherwise, it is determined that it is unnecessary to transmit the SID frame; and to output the DTX decision criterion; and wherein, the characteristic information variation obtaining module further comprises:

a lower-band characteristic information variation obtaining sub-module configured to obtain variation of characteristic information of a lower-band signal, and a higher-band characteristic information variation obtaining sub-module configured to obtain variation of characteristic information of a higher-band signal;

the lower-band characteristic information variation obtaining sub-module further comprises:

a lower-band layering unit, configured to divide the input lower-band signal into a lower-band core layer signal and a lower-band enhancement layer signal, and to transmit the lower-band core layer signal and lower-band enhancement layer signal respectively to a lower-band core layer characteristic information variation obtaining unit and a lower-band enhancement layer characteristic information variation obtaining unit;

the lower-band core layer characteristic information variation obtaining unit, configured to obtain variation of characteristic information of the lower-band core layer signal;

the lower-band enhancement layer characteristic information variation obtaining unit; configured to obtain variation of characteristic information of the lower-band enhancement layer signal;

a lower-band synthesizing unit, configured to synthesize the variation of the characteristic information of the lower-band core layer signal obtained by the lower-band core layer characteristic information variation obtaining unit and the variation of the characteristic information of the lower-band enhancement layer signal obtained by the lower-band enhancement layer characteristic information variation obtaining unit, as the variation of the characteristic information for the lower band; and a lower-band control unit, configured to take an output of a lower-band core layer decision sub-module as the variation of the characteristic information of the lower band signal when the lower-band signal involves only the lower-band core layer; and to take the output of the lower-band synthesizing unit as the variation of the characteristic information of the lower band signal when the sub-band signal is up to the lower-band enhancement layer.

6. A discontinuous transmission (DTX) decision device incorporated in a hardware-based audio coder, comprising:

a band-splitting module of the hardware-based audio coder, configured to receive input signal(s) and obtain sub-band signal(s) by splitting the input signal(s);

a characteristic information variation obtaining module of the hardware-based audio coder, configured to receive the sub-band signal(s) from the band-splitting module and obtain a variation of characteristic information of each of the sub-band signals, wherein the variation of characteristic information is a variation value of the obtained characteristic information of the signal within each of the sub-bands compared with the characteristic information of the signal within the sub-band obtained at a past time;

a decision module of the hardware-based audio coder, configured to receive the variation of characteristic information, perform a combined decision on the variation of the characteristic information of each of the sub-band signals and taking a result of the combined decision as a DTX decision criterion; if the result is larger than a threshold, it is determined that an Silence Insertion Descriptor (SID) frame be transmitted; otherwise, it is determined that it is unnecessary to transmit the SID frame; and to output the DTX decision criterion; and wherein, the characteristic information variation obtaining module further comprises:

a lower-band characteristic information variation obtaining sub-module, configured to obtain variation of characteristic information of a lower-band signal;

a higher-band characteristic information variation obtaining sub-module, configured to obtain variation of characteristic information of a higher-band signal; and an ultrahigh-band characteristic information variation obtaining module, configured to obtain variation of characteristic information of a ultrahigh-band signal;

the lower-band characteristic information variation obtaining sub-module further comprises:

a lower-band layering unit, configured to divide the input lower-band signal into a lower-band core layer signal and a lower-band enhancement layer signal, and to transmit the lower-band core layer signal and lower-band enhancement layer signal respectively to a lower-band core layer characteristic information variation obtaining unit and a lower-band enhancement layer characteristic information variation obtaining unit;

the lower-band core layer characteristic information variation obtaining unit, configured to obtain variation of characteristic information of the lower-band core layer signal;

the lower-band enhancement layer characteristic information variation obtaining unit; configured to obtain variation of characteristic information of the lower-band enhancement layer signal;

a lower-band synthesizing unit, configured to synthesize the variation of the characteristic information of the lower-band core layer signal obtained by the lower-band core layer characteristic information variation obtaining unit and the variation of the characteristic information of the lower-band enhancement layer signal obtained by the lower-band enhancement layer characteristic information variation obtaining unit, as the variation of the characteristic information for the lower band; and a lower-band control unit, configured to take an output of a lower-band core layer decision sub-module as the variation of the characteristic information of the lower band signal when the lower-band signal involves only the lower-band core layer; and to take the output of the lower-band synthesizing unit as the variation of the characteristic information of the lower band signal when the sub-band signal is up to the lower-band enhancement layer.

7. A discontinuous transmission (DTX) decision device incorporated in a hardware-based audio coder, comprising:

a band-splitting module of the hardware-based audio coder, configured to receive input signal(s) and obtain sub-band signal(s) by splitting the input signal(s);

a characteristic information variation obtaining module of the hardware-based audio coder, configured to receive the sub-band signal(s) from the band-splitting module and obtain a variation of characteristic information of each of the sub-band signals, wherein the variation of characteristic information is a variation value of the obtained characteristic information of the signal within each of the sub-bands compared with the characteristic information of the signal within the sub-band obtained at a past time; and a decision module of the hardware-based audio coder, configured to receive the variation of characteristic information, perform a combined decision on the variation of the characteristic information of each of the sub-band signals and taking a result of the combined decision as a DTX decision criterion; if the result is larger than a threshold, it is determined that an Silence Insertion Descriptor (SID) frame be transmitted; otherwise, it is determined that it is unnecessary to transmit the SID frame; and to output the DTX decision criterion; and wherein, the characteristic information variation obtaining module further comprises:

a lower-band characteristic information variation obtaining sub-module configured to obtain variation of characteristic information of a lower-band signal, and a higher-band characteristic information variation obtaining sub-module configured to obtain variation of characteristic information of a higher-band signal;

the higher-band characteristic information variation obtaining sub-module further comprises:

a higher-band layering unit, configured to divide the input higher-band signal into a higher-band core layer signal and a higher-band enhancement layer signal, and to transmit the higher-band core layer signal and higher-band enhancement layer signal respectively to a higher-band core layer characteristic information variation obtaining unit and a higher-band enhancement layer characteristic information variation obtaining unit;

the higher-band core layer characteristic information variation obtaining unit, configured to obtain variation of characteristic information of the higher-band core layer signal;

the higher-band enhancement layer characteristic information variation obtaining unit, configured to obtain variation of characteristic information of the higher-band enhancement layer signal;

a higher-band synthesizing unit, configured to synthesize the variation of the characteristic information of the higher-band core layer signal obtained by the higher-band core layer characteristic information variation obtaining unit and the variation of the characteristic information of the higher-band enhancement layer signal obtained by the higher-band enhancement layer characteristic information variation obtaining unit, as the variation of characteristic information for the higher band; and a higher-band control unit, configured to take an output of a higher-band core layer decision sub-module as the variation of the characteristic information of the higher band signal when the higher-band signal involves only the higher-band core layer; to take the output of the higher-band synthesizing unit as the variation of the characteristic information of the higher band signal when the sub-band signal is up to the higher-band enhancement layer.

8. A discontinuous transmission (DTX) decision device incorporated in a hardware-based audio coder, comprising:

a band-splitting module of the hardware-based audio coder, configured to receive input signal(s) and obtain sub-band signal(s) by splitting the input signal(s);

a characteristic information variation obtaining module of the hardware-based audio coder, configured to receive the sub-band signal(s) from the band-splitting module and obtain a variation of characteristic information of each of the sub-band signals, wherein the variation of characteristic information is a variation value of the obtained characteristic information of the signal within each of the sub-bands compared with the characteristic information of the signal within the sub-band obtained at a past time; and a decision module of the hardware-based audio coder, configured to receive the variation of characteristic information, perform a combined decision on the variation of the characteristic information of each of the sub-band signals and taking a result of the combined decision as a DTX decision criterion; if the result is larger than a threshold, it is determined that an Silence Insertion Descriptor (SID) frame be transmitted; otherwise, it is determined that it is unnecessary to transmit the SID frame; and to output the DTX decision criterion; and wherein, the characteristic information variation obtaining module further comprises:

a lower-band characteristic information variation obtaining sub-module, configured to obtain variation of characteristic information of a lower-band signal;

a higher-band characteristic information variation obtaining sub-module, configured to obtain variation of characteristic information of a higher-band signal; and an ultrahigh-band characteristic information variation obtaining module, configured to obtain variation of characteristic information of a ultrahigh-band signal;

the higher-band characteristic information variation obtaining sub-module further comprises:

a higher-band layering unit, configured to divide the input higher-band signal into a higher-band core layer signal and a higher-band enhancement layer signal, and to transmit the higher-band core layer signal and higher-band enhancement layer signal respectively to a higher-band core layer characteristic information variation obtaining unit and a higher-band enhancement layer characteristic information variation obtaining unit;

the higher-band core layer characteristic information variation obtaining unit, configured to obtain variation of characteristic information of the higher-band core layer signal;

the higher-band enhancement layer characteristic information variation obtaining unit, configured to obtain variation of characteristic information of the higher-band enhancement layer signal;

a higher-band synthesizing unit, configured to synthesize the variation of the characteristic information of the higher-band core layer signal obtained by the higher-band core layer characteristic information variation obtaining unit and the variation of the characteristic information of the higher-band enhancement layer signal obtained by the higher-band enhancement layer characteristic information variation obtaining unit, as the variation of characteristic information for the higher band; and a higher-band control unit, configured to take an output of a higher-band core layer decision sub-module as the variation of the characteristic information of the higher band signal when the higher-band signal involves only the higher-band core layer; to take the output of the higher-band synthesizing unit as the variation of the characteristic information of the higher band signal when the sub-band signal is up to the higher-band enhancement layer.

* * * * *